US005934824A

United States Patent [19]

Vural

[11] Patent Number: 5,934,824

[45] Date of Patent: Aug. 10, 1999

[54] VIBRATION ROLLER WITH AT LEAST ONE ROLL TIRE AND A DOUBLE SHAFT VIBRATION GENERATOR ARRANGED THEREIN

[75] Inventor: Gülertan Vural, Emmelshausen, Germany

[73] Assignee: Wacker Werke GmbH & Co. KG, München, Germany

[21] Appl. No.: 08/817,588

[22] PCT Filed: Aug. 7, 1996

[86] PCT No.: PCT/EP96/03499

§ 371 Date: Jun. 6, 1997

§ 102(e) Date: Jun. 6, 1997

[87] PCT Pub. No.: WO97/06308

PCT Pub. Date: Feb. 20, 1997

[30] Foreign Application Priority Data

Aug. 8, 1995 [DE] Germany ..... 195 29 115

[51] Int. Cl.[6] ..... E01C 19/38; E01C 19/26

[52] U.S. Cl. ..... 404/117; 404/122

[58] Field of Search ..... 404/117, 122, 404/130; 405/271

[56] References Cited

U.S. PATENT DOCUMENTS 4,201,493 5/1980 Braun ..... 404/117
4,454,780 6/1984 Goehler et al. ..... 74/87
5,248,216 9/1993 Vural ..... 404/75
5,797,699 8/1998 Blancke et al. ..... 404/117

*Primary Examiner*—Thomas B. Will
*Assistant Examiner*—Gary S. Hartmann
*Attorney, Agent, or Firm*—Robert W. Becker & Associates

[57] ABSTRACT

A vibration roller has at least one roll tire having a double shaft vibration generator arranged therein. The vibration generator has a first and a second driven unbalance shafts arranged in the roll tire. The roll tire has an inner support at which the first and second driven unbalance shafts are rotatably supported. The first and second driven unbalance shafts are coaxially arranged relative to one another on a common rotational axis such that the second driven unbalance shaft is rotatable about the first driven unbalance shaft. The common rotational axis of the first and second driven unbalance shafts coincide with the drive axis of the roll tire. For a first operational state of the vibration roller in which a directed vibration is generated, the first and second driven unbalance shaft are coupled such that the first and second driven unbalance shafts rotate in opposite directions to one another and a position angle between a maximum resulting centrifugal force (force vector) and a travel direction of the vibration roller is selectable as desired. For a second operational state of the vibration roller in which a circular vibration about the roll tire is generated, the first and second driven unbalance shafts are coupled such that the first and second driven unbalance shafts rotate in the same direction and a relative phase position for adjusting a value of the resulting centrifugal force is selectable as desired.

23 Claims, 8 Drawing Sheets

$\alpha - 0°$ $\alpha$ =90°

VIBRATION ROLLER WITH AT LEAST ONE ROLL TIRE AND A DOUBLE SHAFT VIBRATION GENERATOR ARRANGED THEREIN

BACKGROUND OF THE INVENTION

The invention relates to a vibration roller with at least one roll tire and a double shaft vibration generator arranged therein wherein the motorically driven unbalance shafts thereof are rotatably supported in a common support contained within the roll tire such that their respective axis of rotation extends parallel to the drive axis of the roll tire.

Vibration rollers of this kind are known from European Patent Application 0 530 546 A1. In these known vibration rollers the two unbalance shafts of the double shaft vibration generator extend parallel to one another on opposite sides of the drive axle of the respective roll tire symmetrically thereto and are rotatably supported in a common generator housing which itself is supported pivotably in a common carrier within the respective roll tire. One of the two unbalance shafts is rotatably driven via gear wheels by a hydraulic drive motor and is coupled with gear wheels to the other drive shaft such that the two unbalance shafts rotate at all times in opposite directions with the same rpm in the generator housing. The flyweights of the two unbalance shafts have the same mass and the same center of gravity spacing so that the vibration generator within the two roll tires produce the same oriented vibration which extends radially to the drive axis of the respective roll tire and the orientation of which depends on the spatial adjustment of the housing of the unbalance shafts.

The solution according to European patent application 0 530 546 A1 is advantageously suitable in connection with soil types which can be compacted best by application of shearing strain and combinations of shearing and compressive strain and it is also well suitable for an economical compaction of relatively great layer thicknesses. Furthermore, a slip produced by the shearing and compressive strain combinations can be counteracted and the traction of the roller can be improved.

The solution according to European Patent Application 0 530 546 A1 has, however, also disadvantages.

In practice, the change of driving orientation takes, especially on bituminous material, approximately 10 to 15 seconds so that for a driving velocity of approximately 5 km/h for the braking process and the subsequent acceleration to 5 km/h in the counter direction a travel distance of 3.5 to 5 m is required. Along this travel distance the vibrator housing is mirror symmetrically adjusted with respect to the vertical plane. This adjustment process causes constantly changing compressive and shearing strain on the soil so that inhomogeneous compaction and undesirable rut formation results. In order to maintain such an inhomogeneous compaction and rut formation within allowable limits, the adjustment process would have to be performed within a fraction of a second which, however, with the known vibration roller is practically not achievable because the vibration generator with respect to the pivot axis has a very large moment of inertia ($I=\Sigma mr^2$) which is caused by the pivotable generator housing itself, by the relatively large distance of the unbalanced shafts from the pivot axis of the generator housing coinciding with the drive axis of the roll tire as well as by the bearing and drive units. For pivoting the generator housing a torque $M_d=I^* \Delta W/\Delta t$ is required. This torque thus increases proportionally with I and the angular acceleration $\Delta W/\Delta t$. This means that the shorter the pivoting time is and the greater the moment of inertia I of the generator system, the greater the torque must be. The greater the required torque, the more complicated, however, is the control process.

Furthermore, pivotable generator housings that contain the complete construction of the generator system and the additional pivot bearings require a high technical expenditure and are expensive.

A further disadvantage of the known vibration roller according to European Patent Application 0 530 546 A1 is the unfavorable traction behavior under certain operating conditions.

During compaction process with a vibration roller, that has roll tires with the aforedescribed vibration generators arranged one after another, the roll tire at the forward end in the driving direction has a greater rolling resistance than the rearward one. The hydraulic drive system, provided for both roll tires and switched in parallel, will adjust to the greater required drive moment. For the rearward roller the drive moment is then too large. This favors a slipping of the roller. A possibly provided anti-slip control tries to prevent slip by providing different adjustment angles of the vibration generators in the leading and the rearward roll tire. However, this means that the two roll tires exert different compressive and shearing strain onto the soil which constantly change during driving. This also results in an undesirable inhomogeneous compaction. This inhomogeneous compaction is made even more uncontrollable by the friction coefficient between the roll tire and the soil, by changes of the rolling resistance, and by erroneous driving behavior of the driver.

A further known vibration roller (European Patent Application 053 598 A0) comprises two unbalanced shafts arranged on the roller axle which rotate synchronously with the same rpm, but phase-displaced by 180° relative to one another. The arrangement is such that the vertical forces generator by the unbalanced shafts are compensated, while the oppositely generated horizontal forces produce a torque acting onto the roll tires about the axis of rotation of the roll tire, respectively, the drive axle. This torque exerts an shearing load onto the soil with regard to its absolute value is unchangeable. Tests have shown that this solution is advantageous for the compaction of thin-layer, loose and bituminous material and also leads to advantageous results with respect to the required minimal noise and vibration exposure for the operating personnel. However, this known vibration roller cannot be economically used, in general, for greater layer thickness and for non-loose materials, for example, mixed soils, bonding soils, and rock. Furthermore, the known roller is very prone to slipping, which results in traction problems especially on downslopes or inclines. Also, the known roller according to European Patent Application 053 598 A0 is constructively very complicated because the unbalance shafts must be supported at a great distance from the drive axis of the roll tires for generating the desired torque.

In German Patent Application 32 25 235 A1 a vibration generator arranged within a roller is disclosed which has two concentrically arranged unbalanced shafts that are commonly driven by a hydraulic motor. One unbalanced shaft can be axially displaced by a translatory movement and can be disengaged by a splined shaft clutch in order to adjust it in different rotational positions relative to the other unbalance shaft. In this manner it is possible to increase or decrease the vibration amplitude. This known vibration mechanism is suitable for exerting complex strains onto certain types of soils because the available kinetic energy, as a function of the amplitude adjustment, can be increased and decreased with a square function; however, such amplitude adjusting solutions have certain application-technological disadvantages under certain operating conditions. For example, it is not possible to generate controlled compressive and shearing strain combinations for a homogenous and economical compaction of certain soil types. Furthermore, a metering of the available kinetic energy, which changes as a square function of the amplitude adjustment, is problematic because an erroneous adjustment of the available kinetic energy causes undesirable surface loosening and material destruction for bituminous material with increasing compaction degree. Furthermore, the aforedisclosed known vibration mechanism does not fulfill the requirements with respect to a careful use of the compacting device and a minimal noise and vibration exposure of the operating personnel and the surroundings. Moreover, the known vibration generator is of a complicated construction and prone to breakdown.

In Swiss Patent 271 578 a vibration plate with a vibration generator placed onto the soil contacting plate is represented and disclosed which comprises two coaxially extending unbalance shafts, thus rotating about a common rotational axis, which are adjustable in regard to their respective phase position by a differential among them in opposite rotating direction with synchronous rpm so that it is possible to change the direction of action of the vibration produced by the unbalance shafts relative to the soil contacting plate. The vibration plate can thus be operated so as to move automatically in forward and reverse mode.

German Patent Application 195 39 150 A1 shows and discloses in different embodiments vibration drives for vibration machines that all have coaxially disposed unbalanced shafts. The vibration drives are provided especially for use with vibration jigs and conveying devices. In all embodiments except one the unbalanced shafts are forcedly driven during operation in opposite direction without the possibility of adjusting the relative phase relation. In the one embodiment that differs from the others a drive with the same rotational orientation requires a separate drive for each unbalance shaft which requires a considerable technical expenditure.

Based on the aforementioned prior art, the invention is thus concerned with providing a universally applicable vibration roller that allows, depending on its adjustment, to:

generate about the roll tire axis oscillating rotational vibrations so that primarily shearing strain is exerted onto the soil to be compacted;

introduce at the roll tire axis an oriented force and to adjust the force vector as desired in all directions in order to be able to exert onto the soil to be compacted an optimally combined compressive and shearing strain; or generate a centrifugal force that is introduced at the roll tire axis and acts in a rotating manner about it and is adjustable in regard to its value in order to exert complex tensions onto the soil to be compacted.

Despite the large number of adjustment possibilities, the inventive vibration roller should have a simple constructive design, a low break-down probability, and a long service life.

SUMMARY OF THE INVENTION

The vibration roller according to the present invention is primarily characterized by:

at least one roll tire having a double shaft vibration generator arranged therein;

the double shaft vibration generator comprising a first driven unbalance shaft and a second driven unbalance shaft arranged in the at least one roll tire;

the roll tire having an inner support;

the first and second driven unbalance shafts rotatably supported in the inner support;

the first and second driven unbalance shaft coaxially arranged relative to one another on a common rotational axis such that the second driven unbalance shaft is rotatable about the first driven unbalance shaft; the roll tire having a drive axis;

the common rotational axis of the first and second driven unbalance shafts coinciding with the drive axis of the roll tire;

wherein, for a first operational state of the vibration roller in which a directed vibration is generated, the first and second driven unbalance shaft are coupled such that the first and second driven unbalance shafts rotate in opposite directions to one another and wherein a position angle between a maximum resulting centrifugal force (force vector) and a travel direction of the vibration roller is selectable as desired; and wherein, for a second operational state of the vibration roller in which a circular vibration about the roll tire is generated, the first and second driven unbalance shaft are coupled such that the first and second driven unbalance shafts rotate in the same direction and wherein a relative phase position for adjusting a value of the resulting centrifugal force is selectable as desired.

The first and second driven unbalance shafts are preferably supported in the at least one roll tire so as to be unaffected by a rotational movement of the roll tire.

The support is comprised of two axially spaced end faces of the roll tire, wherein each one of the end faces comprise a first bearing housing with a first roller bearing arranged therein for supporting the second driven unbalance shaft.

Expediently, the vibration roller further comprises an undercarriage, wherein the first roller bearings function simultaneously as drive bearings for supporting the roll tire at the undercarriage.

The vibration roller may also comprise second roller bearings mounted within the second driven unbalance shaft in the vicinity of the first bearing housings, wherein the first driven unbalance shaft is supported in the second roller bearings.

In the first operational state the position angle, which can also be defined as the angle between the force vector and a plane extending parallel to the ground and containing the drive axis of the roll tire, is adjustable over the entire range of 360°.

For bringing the vibration roller into the second operational state, the first and second driven unbalance shafts are manually coupled and the relative phase position is manually selected while the vibration roller is in a standstill position.

For bringing the vibration roller into the second operational state, the first and second driven unbalance shafts are automatically coupled and the relative phase position is automatically selected.

At least in the second operational state the direction of rotation of the first and second driven unbalance shafts is changeable.

For bringing the vibration roller into the first operational state, the first and second driven unbalance shafts are manually coupled and the position angle is manually selected while the vibration roller is in a standstill position.

For bringing the vibration roller into the first operational state, the first and second driven unbalance shafts are automatically coupled and the position angle is automatically selected.

The vibration roller further comprises a differential, connected to a first end of the first driven unbalance shaft and to a first end of the second driven unbalance shaft, and further comprising a control drive connected to the differential. The differential comprises two oppositely rotating central gears of identical number of teeth. A first one of the central gears is fixedly and coaxially connected to the first driven unbalance shaft. A second one of the central gears is fixedly and coaxially connected to the second driven unbalance shaft. The differential comprises a stay rotatable about the drive axis of the roll tire. The control drive drives the stay in rotation for selecting a relative phase position between the first and second driven unbalance shafts. The stay is arrestable for a selected relative phase position at a roll tire holder of the roll tire.

The differential is advantageously a bevel gear arrangement.

The stay is embodied as a pivotable housing surrounding the first end of the first driven unbalance shaft. The pivotable housing has a first end face facing the roll tire holder. The control drive comprises a control motor connected to the roll tire holder. The control drive comprises a control gear connected to the first end face of the pivotable housing so as to be coaxial with the drive axis of the roll tire. The control drive further comprises a pinion driven by the control motor. The control gear meshes with the pinion.

For bringing the vibration roller into the second operational position, the stay is coupled with one of the first and second driven unbalance shafts, and the pinion and the control gear are detachable from one another.

The roll tire comprises two axially spaced end faces and one of the end faces has connected thereto a drive bearing housing in which the stay is rotatably supported.

The drive bearing housing encloses the differential so as to form a protective housing.

The vibration roller further comprises a comparator element, a first transducer and a second transducer connected to the comparator element, and a control drive, wherein, in the first operational state, the first transducer sends first signals of an angular velocity and an angular acceleration of a non-slip roll tire to the comparator element and the second transducer sends second signals of an angular velocity and an angular acceleration of a roll tire having a tendency to slip to the comparator element, wherein the comparator element compares the first and second signals and, upon surpassing of a preset difference of the first and second signals, activates the control drive to reduce accordingly the position angle.

The first and second driven unbalance shafts have identical flywheel effects.

The invention also relates to a method for operating the inventive vibration roller. The method for operating a vibration roller according to the present invention is characterized by the step of adjusting in the first operational state the position angle to be 0° to 45° for loose or bituminous soils and to be 45° to 90° for soils that are difficult to compact.

The method further includes the step of program-controlling the position angle as a function of a thickness of the soil to be compacted.

The method may also include the step of automatically adjusting mirror-symmetrically the force vector to a plane extending parallel to the ground and containing the drive axis, when a reversal of travel direction occurs.

The method may further include the step of reducing program-controlled the position angle with each pass across the soil to be compacted.

The inventive vibration roller can be adapted optimally to the different requirements of the soil to be compacted such that the advantageous effect of the different known vibration rollers can be maintained but there disadvantages can be avoided.

A special advantage of the inventive vibration roller is that the moment of inertia of the vibration generator relative to the drive axis of the respective roll tire is very minimal, for example, in comparison to the vibration roller according to European Patent Application 0 530 546 A1, is practically smaller by a factor ten, so that the vibration generator in the adjustment for introducing an oriented vibration force at the drive axis of the roll tire for changing the orientation of the directed vibration requires a substantially reduced torque as compared to known rollers and, accordingly, can be pivoted into the new direction in a substantially shorter amount of time so that it is possible to minimize inhomogeneous compacting and rut formation in the compacted soil.

With the inventive device it is possible, for different soil types and layer thickness, to achieve an optimal compacting by selecting from a plurality of possibilities a basic adjustment position of the vibration generator system with the resulting different shearing and compressive strain combinations, and slip events can also be maintained within a permissible range.

BRIEF DESCRIPTION OF THE DRAWINGS

The invention will subsequently be explained in detail with the aid of drawings of one embodiment. It is shown in the drawing.

DESCRIPTION OF PREFERRED EMBODIMENTS

Figure 1:
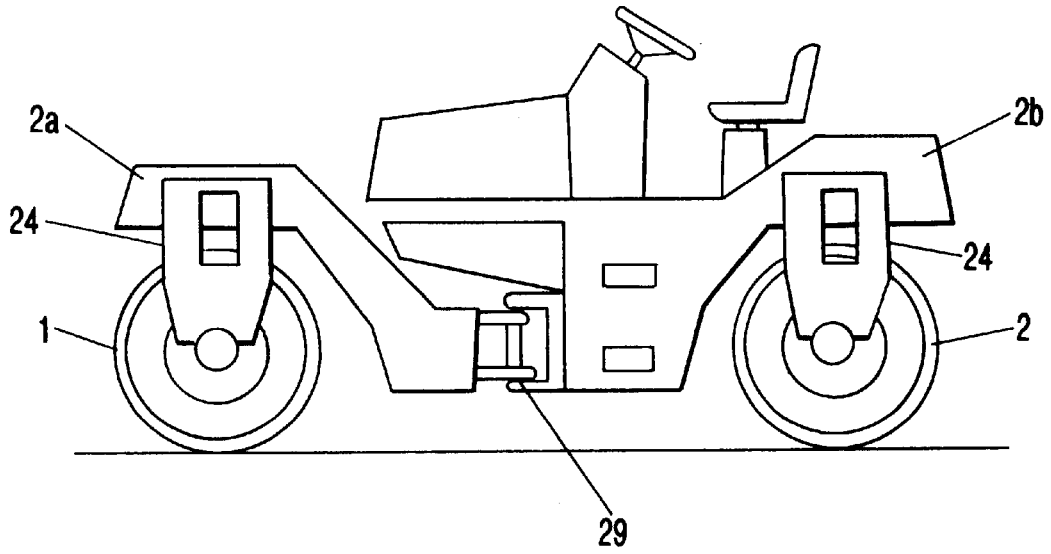
FIG. 1 a side view of the inventive vibration roller with two roll tires.

The vibration roller represented in FIG. 1 comprises two roll tires 1 and 2 arranged sequentially in the driving direction. On the roll tire 1 a frame 2*a* is arranged and on the roll tire 2 a frame 2*b* with driver stand is provided. The frames 2*a* and 2*b* are connected to one another with a vertical pivot bearing 29 in order to provide steerability of the vibration roller.

Figure 2:
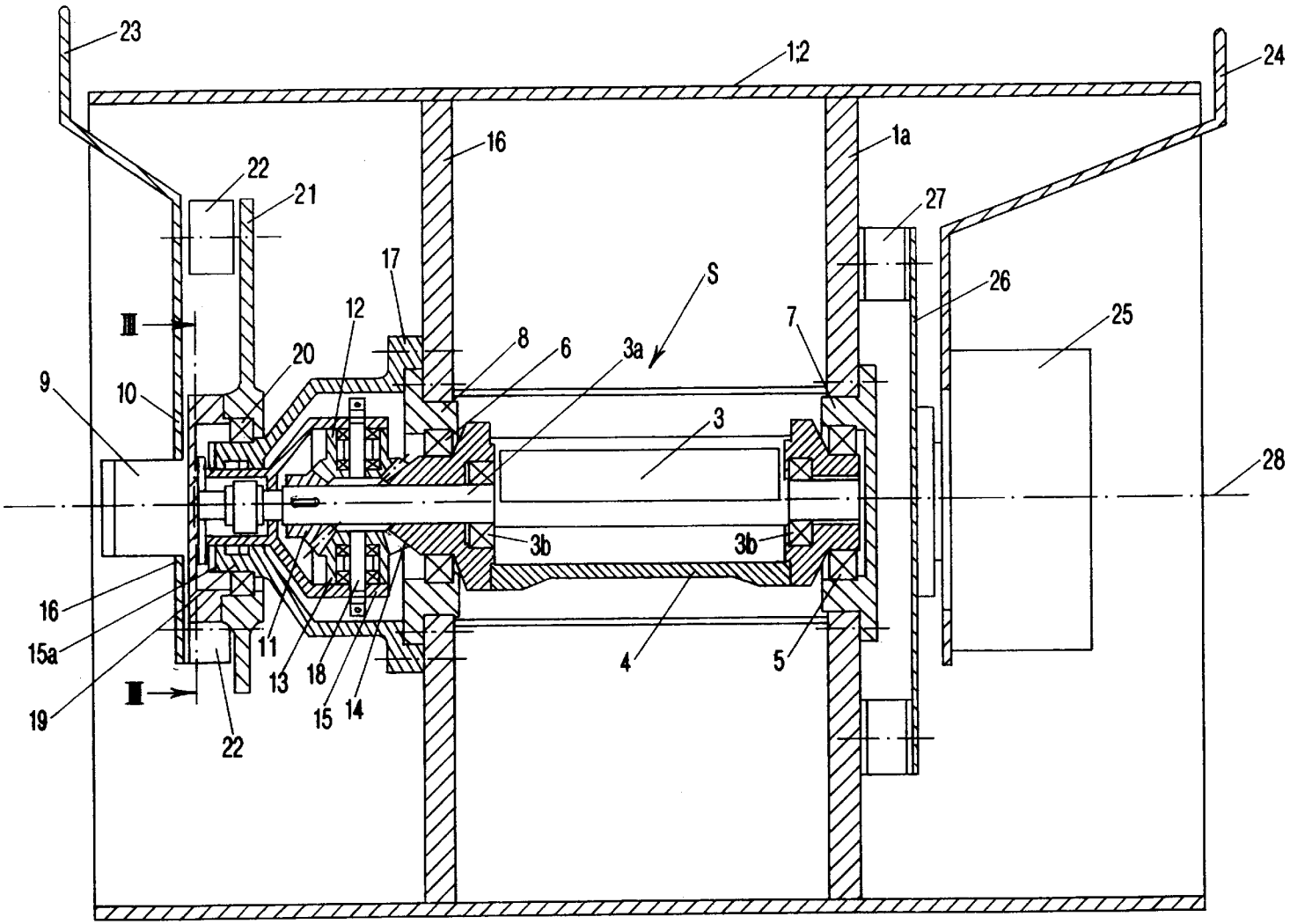
FIG. 2 an axial cross-section through one of the two identical roll tires of the vibration roller of FIG. 1.

In both roll tires 1 and 2 a double shaft vibration generator S is arranged, the construction of which will appear more clearly from FIG. 2.

According to FIG. 2, in the interior of each roll tire 1, 2 two coaxially arranged unbalance shafts 3 and 4 are provided whereby the inner unbalance shaft 3 is rotatably supported with the aid of roller bearings 3*b* at its end faces in the surrounding outer unbalance shaft 4.

The outer unbalance shaft 4 is rotatably supported with the aid of roller bearings 5, 6 in bearing housings 7, 8 at its ends in respective supports 1*a* and 1*b*, arranged within the roll tires 1 and 2 and penetrating them in the diagonal direction, such that its axis of rotation 28, which at the same time corresponds to the axis of rotation of the inner unbalance shaft 3, coincides with the roll tire axis about which the roll tires 1, 2 rotate relative to the roll tire holder (undercarriage) 23, 24 that is connected to the respective roller frame 2*a*, 2*b* on one or the other side of the roll tires 1, respectively, 2 and projects into the roll tire at their end faces.

At the end of FIG. 2 that is the left hand side for an observer, the outer unbalance shaft 4 comprises a bevel gear 14 coaxially extending to the axis of rotation 28. The inner unbalance shaft 3 has an extension 13*a* extending through the left end face of the outer unbalance shaft 4 and through the bevel gear 14 connected thereto. A bevel gear 11 is fastened to the projection at an axial distance from and facing the bevel gear 14. In the embodiment it has the same diameter and the same number of teeth as the bevel gear 14 at the outer unbalance shaft 4. The two bevel gears 11 and 14 form a differential together with two bevel gears 12 and 13 meshing therewith and positioned diametrically opposite one another relative to the extension 3*a* and rotatable about an axis of rotation intercepting the axis of rotation 28 at a right angle. The differential comprises a stay 15 that is embodied as a housing surrounding completely the extension 3*a* and, at the side of FIG. 1 that is the left hand side for an observer, has a closed end face. It extends to the left as a tubular projection that has an open end face to which is connected the gear wheel 16. The stay 15 forms a pivotable housing that is rotatably connected with roller bearings in the drive bearing housing 17 that extends coaxially to the drive axle 28 and is fastened to the support 1*b* at the side of FIG. 2 that is the left hand side for the observer and surrounds the differential.

The drive bearing housing 17 comprises, at the side of FIG. 2 that is the left hand side for the observer, a collar concentric to the drive axis 28 with which it is supported via a roller bearing 20 in a bearing plate 21 that is connected with resilient pads 22 to the holder 23. The bearing plate 21, that forms a non-rotating unit together with the roll tire holder 23, supports a drive motor 9 having a drive shaft coaxial to the drive axis 28. The drive shaft is connected to the extension 3*a* of the inner unbalance shaft 3 via clutch 10 supported in the tubular projection of the stay 15 of the differential.

At the side of FIG. 2 that is the right hand side for the observer, the roll tire 1, respectively, 2 is supported at the holder 24 with a bearing plate 26 which is fastened via resilient pads 27 to the support 1*a* diagonally projecting through the roll tire and is supported coaxially to the drive axis 28 at holder 21 by a bearing not represented in detail in FIG. 2. At the roll tire holder 24 a drive motor 25 is fastened with which the bearing plate 26 can be rotated about the drive axis 28 relative to the roll tire holder 24.

The aforedescribed vibration generator S with its unbalance shafts 3 and 4, connected to one another at one end by the differential, can be operated in two different adjustment positions of the differential relative to the neighboring device parts.

In a first basic position, in the following referred to as adjustment position 1, the housing-like stay 15 of the differential is fixed relative to the support plate 21 by the gear wheel 16, i.e., it is arrested by it, whereby, however, its angular position relative to the bearing plate 21 can be changed coaxially about the drive axis 28 with the aid of the gear wheel (pinion) 30 (FIG. 3), engaging the gear wheel 16 and adjustable with a motor 31, in a controlled manner. Since the stay 15 of the differential is not moving, the inner unbalance shaft 3 that is rotated by the motor 9 is driven via the bevel gears 11, 12, 13 and 14 for driving the outer unbalance shaft 4 in the opposite direction relative to the inner unbalance shaft 3 with the same rpm so that the vibration generator S produces an oriented vibration, the vector of which, because of the coaxial arrangement of the unbalance shafts 3 and 4, intercepts the driving axle 28 perpendicularly. By rotating the stay 15 relative to the bearing plate 21 with the control motor 31 via the toothed wheels 30 and 16 (FIG. 3), the spatial phase position of the unbalance shafts 3 and 4 and with it the direction of action of the vector of the directed vibration can be changed by the 360° range about the driving axis 28, whereby, however, this adjustment possibility is used only within a predetermined angular range.

Figure 4:
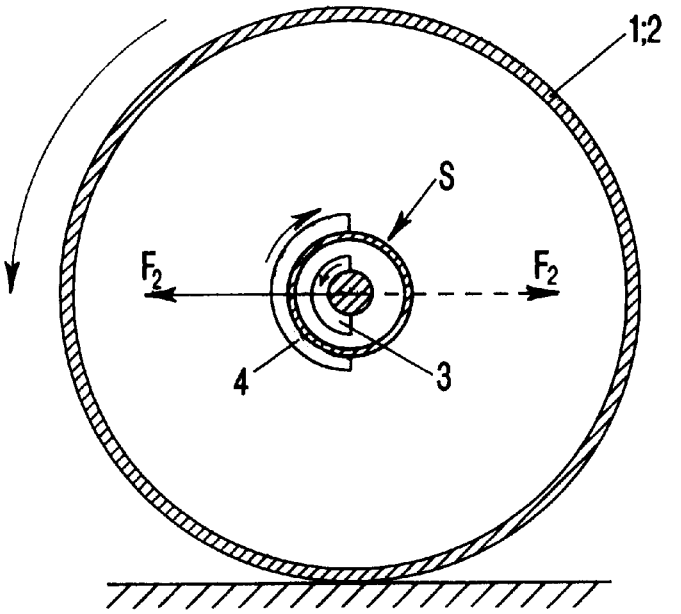
FIG. 4 a schematic representation of one of the possible basic adjustments (adjustment I) of the vibration generator with a force vector acting in the horizontal direction.
Figure 4:
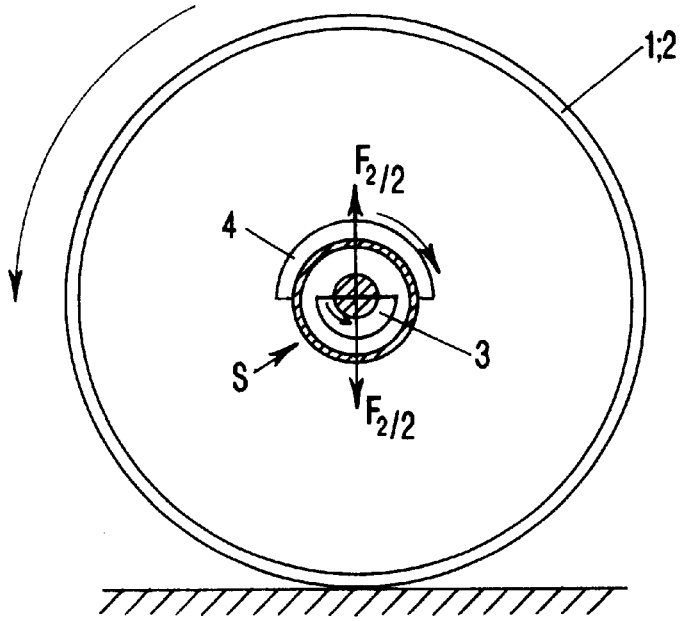
Figure 5:
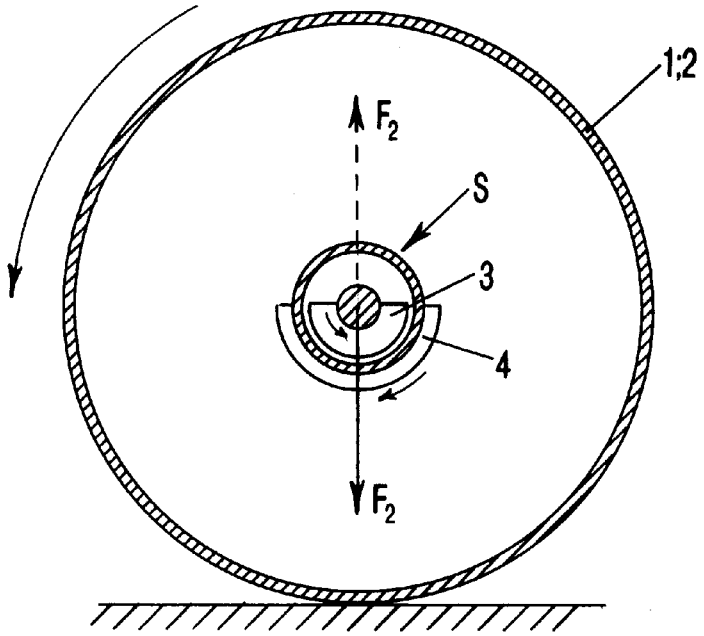
FIG. 5 a schematic representation of the force vector acting in the vertical direction in comparison to FIG. 4.
Figure 5:
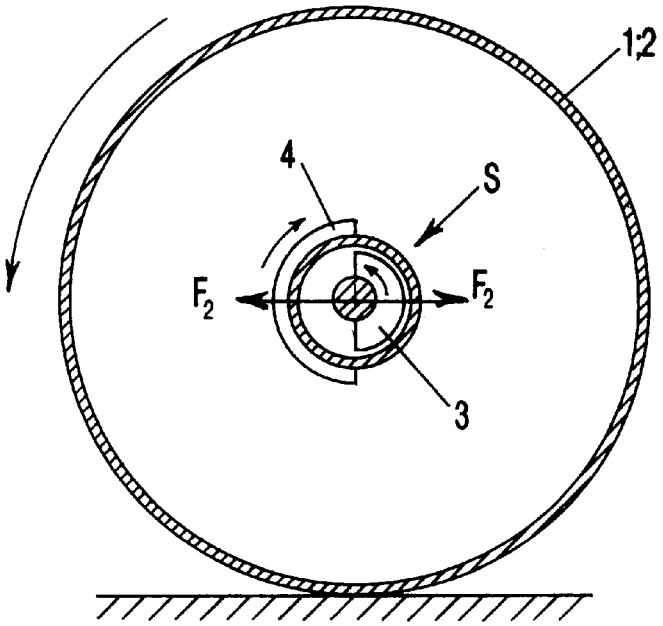
Figure 6:
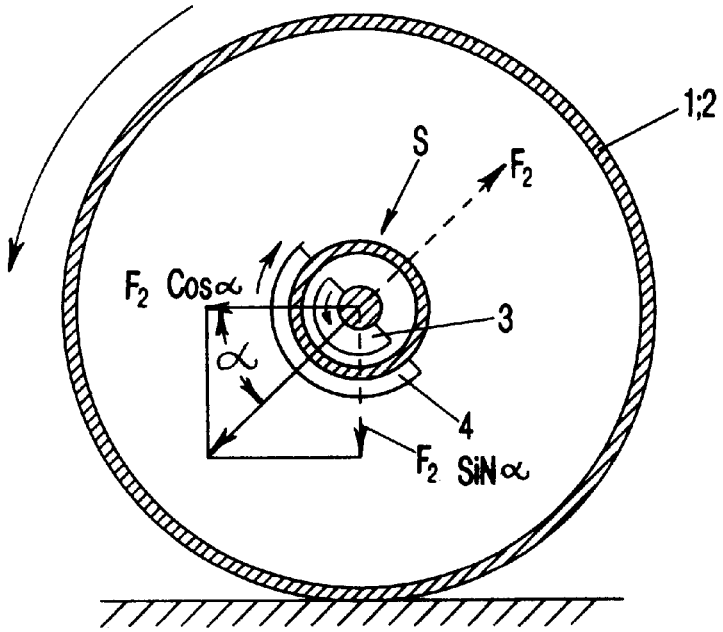
FIG. 6 a schematic representation of a force vector extending at a pivot angle $\alpha$ relative to the horizontal in the same principal basic adjustment as in FIGS. 4 and 5.
Figure 6:
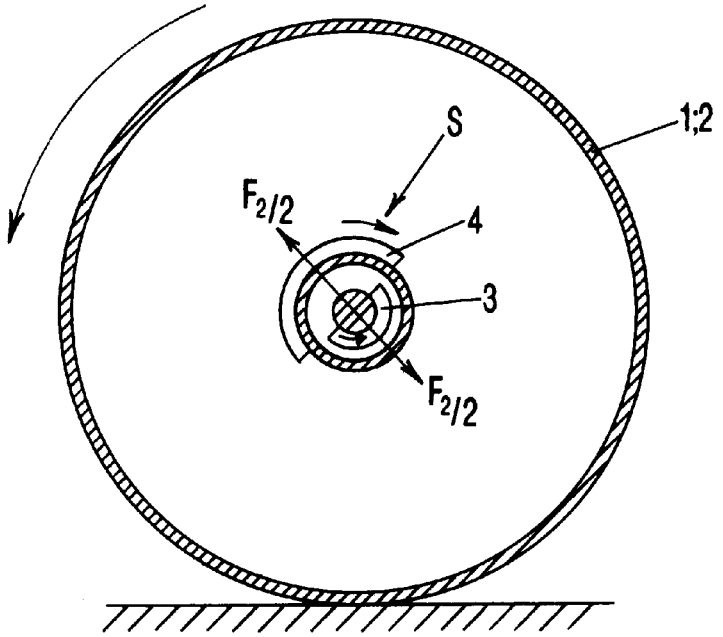

FIGS. 4, 5 and 6 show different adjustments of the spatial phase position of the imbalance shafts 3 and 4 in the principal basic position I and the corresponding direction of action of the vector $F_2$ of the directed vibration. It is obvious that the spatial phase position of the two unbalance shafts 3 and 4, i.e., the pivot angle $\alpha$ of the vibration generator S, is selected such that in the phase position according to FIG. 4 the centrifugal forces produced by the unbalance are reinforced in the horizontal direction and is compensated in the vertical direction, in the phase position according to FIG. 5 the centrifugal forces generated by the unbalance are reinforced in the vertical direction and are compensated in the horizontal direction, and in the phase position according to FIG. 6 the centrifugal forces generated by the unbalance are reinforced in the direction defined by the pivot angle $\alpha$ of the vibration generator S and are compensated in a direction perpendicular thereto. The vibration forces caused by the unbalance shafts 3 and 4 are transmitted respectively by the bearings 5 and 6 and the bearing housing 7 and 8 onto the supports 1*a* and 1*b* and thus onto the respective mantle of the roll tires 1, respectively, 2.

The motor 9 is preferably a hydraulic motor.

The phase displacement performed with the control motor 31 and the gear wheels 30 and 16 can be controlled by hand but also automatically.

Figure 7:
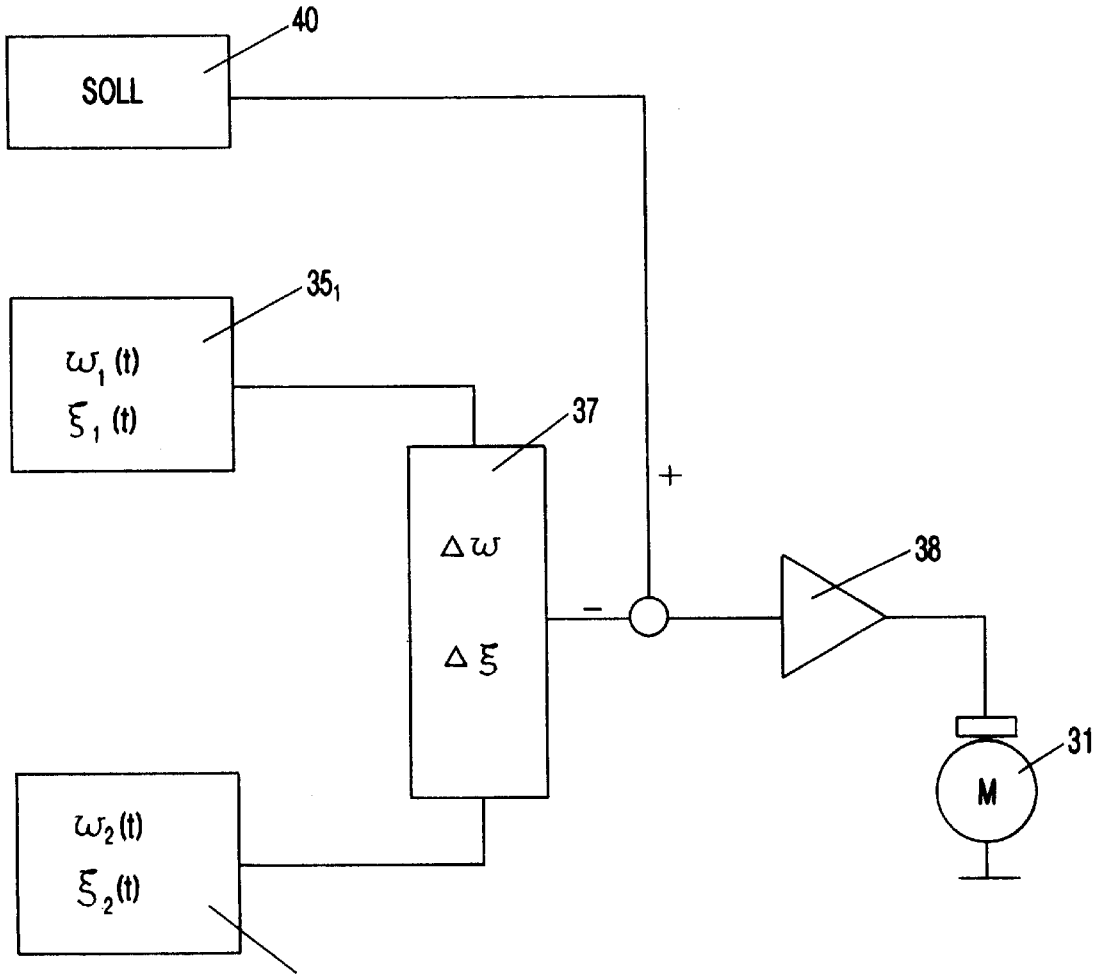
FIG. 7 a schematic representation of a control circuit for the automatic correction of the adjusting angle $\alpha$ of the force vector in the principal adjustment according to FIG. 4 through FIG. 6.

FIG. 7 shows the function of a control circuit for automatically controlling the phase position of the unbalance shafts 3 and 4 in such a manner that a slip of the roll tires 1 and 2 on the soil to be compacted is counteracted. According to FIG. 7, an incremental transducer 35, 36, the design and location of which is not shown in the Figure, is arranged within each one of the roll tires 1 and 2.

The angular acceleration $d\omega/dt=\xi(t)$ and the angular velocity $\omega(t)$ of the roll tires 1 and 2 are measured by it. When a roll tire has the tendency to leave in comparison to the non-slipping roll tire its tolerance range with respect to $\xi(t)$ and $\omega(t)$, the differential values $\Delta\xi$ and $\Delta\omega$ are determined by a comparator element 37 (also not shown in the drawing). When the values $\Delta\xi$ and $\Delta\omega$ surpass a predetermined value preset by a nominal value transducer 40, the two control motors $\mathbf{31}_1$ and $\mathbf{31}_2$ of the roll tires 1 and 2 are activated by an amplifier 38 in such a manner that the angular position of the vibration generator S is changed in the sense of increasing the horizontal component of the resulting centrifugal force until the slip detected by the comparator element 37 is below the limit value. This new pivot angle value is synchronously adjusted in both roll tires 1 and 2. For a change of travel direction, the adjusted or controlled pivot angle value of the centrifugal force is automatically mirror-symmetrically positioned relative to the vertical in the travel direction. Preferably, the positioning is performed as follows.

When the pivot angle of the generator force vector is in the range of 0° to 45°, it is mirror-symmetrically adjusted in the clockwise direction, and when it is in the range of 45° to 90°, it is mirror-symmetrically adjusted counter clockwise.

Numerous experiments have led to the following results and recognitions:

For loose and bituminous materials, dynamic shearing strain with increasing compressive strain component for increasing layer thickness is primarily required.

For an optimal compaction of difficult to compact soils, dynamic compressive strain is primarily needed whereby with increasing layer thickness increasing compressive strain components are required.

The resulting force vector has, depending on the position angle, a horizontal component in the travel direction which has two functions: on the one hand, the generation of the shearing strain required for compacting and, on the other hand, improving traction.

The other vertical force component is directed onto the soil and generates the compressive strain required for compaction, whereby it simultaneously increases the frictional force between the roll tire and the soil. This again is important in regard to the transmission of shearing strain onto the soil to be compacted.

Based on these facts it can be determined that for producing an optimal compaction for loose and bituminous materials the position angle $\alpha$ can vary in the range of 0° to 45° and with increasing thickness of the material layer should reach a value of 45°.

In order to achieve optimal compaction for difficult to compact soils, the position angle $\alpha$ should vary in a range of 45° to 90° and with increasing thickness of the material layer should reach a value of 90°.

Based on numerous testing results the following has been shown:

firstly, depending on the type of soil and layer thickness, a basic value of the position angle of the force vector should take into consideration a certain reserve for traction improvement and friction force increase between the roll tire and the soil, and secondly, an oriented reduction after each compaction pass of the position angle as a function of the soil type and layer thickness can ensure a homogenous compaction within. It is, as previously disclosed, expedient to perform automatically the adjustment of the pivot angle of the force vector in the base position I so that, on the one hand, an optimal compaction can be achieved and, on the other hand, the slip between the roll tire and the soil can be reduced to a non-damaging minimum.

A pre-programmed command instrument installed at the vibration roller makes it possible for the driver to adjust the base position manually.

When the application-oriented base position of the pivot angle of the force vector of the vibration generator S, for example, for both roll tires of a tandem roller, due to the rolling resistance and the coefficient of friction between the roller and the soil, especially for increasing weight distribution differences between the leading roller in the travel direction and the trailing roller is not sufficient for reducing or eliminating the slip tendency of one roller, then it is preferred to use the control discussed above according to which the pre-programmed basic position of the generator system are applied in a corrective manner, in particular at both roll tires of a tandem roller.

According to the invention, the unbalance shafts 3 and 4, in deviation of the aforedescribed basic position I, are also adjustable in a second basic position II in which they rotate in the same rotational direction and in which their relative phase position for adjusting the value of the resulting centrifugal force can be adjusted and fixed.

Figure 3:
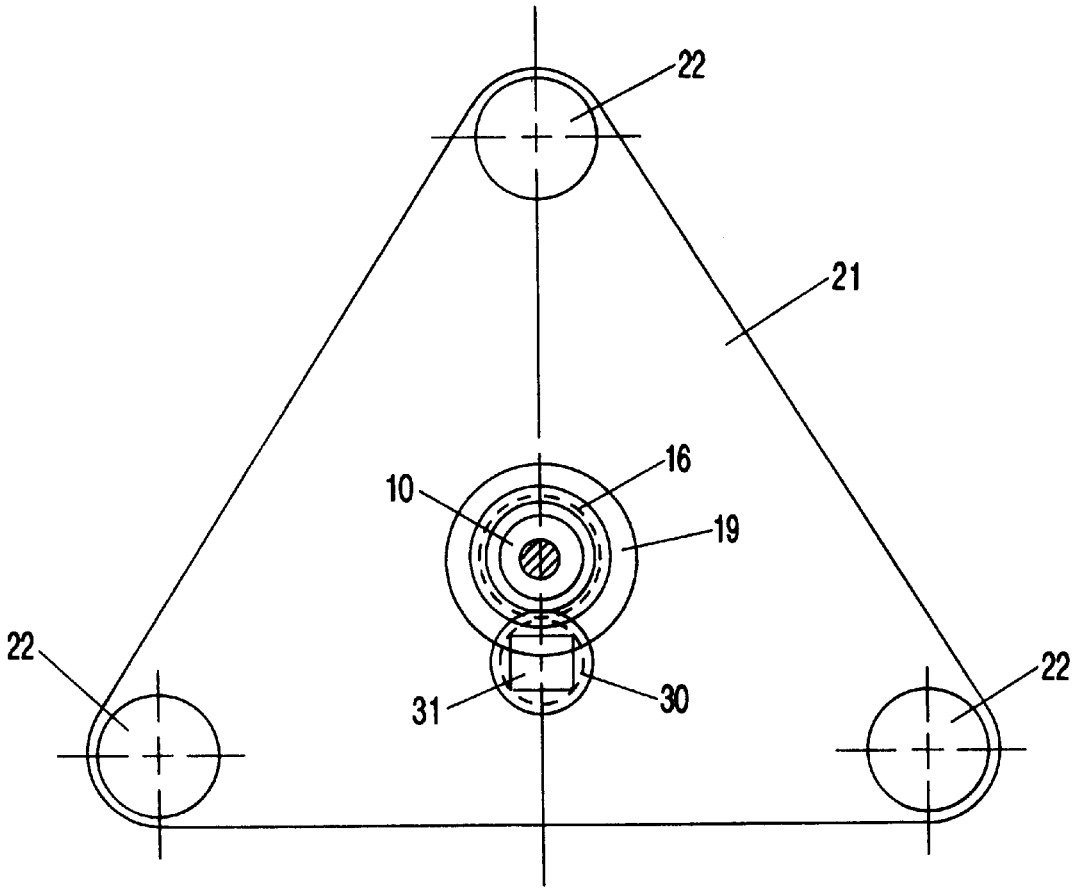
FIG. 3 an end view in cross-section along the section line III—III in FIG. 2.
Figure 8A:
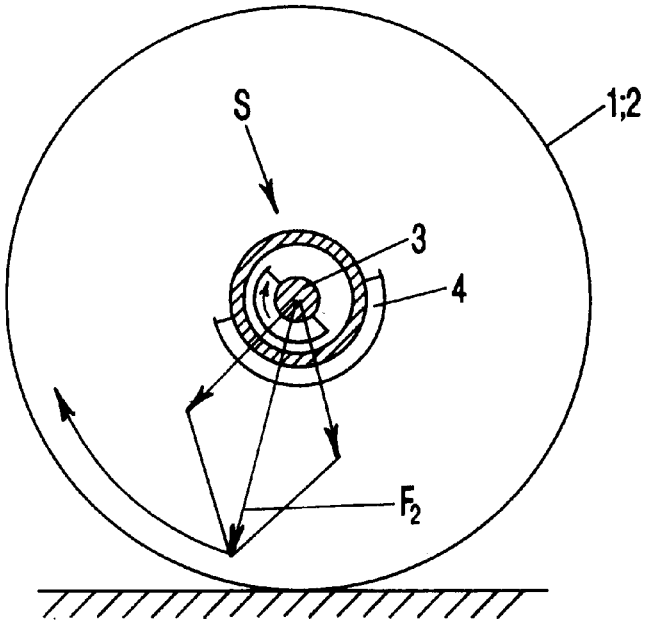
FIGS. 8*a* and 8*b* a schematic representation of a rotating force vector in another possible basic adjustment (adjustment II) of the vibration generator in different relative phase positions of the unbalance shafts and correspondingly different values of the centrifugal force.
Figure 8B:
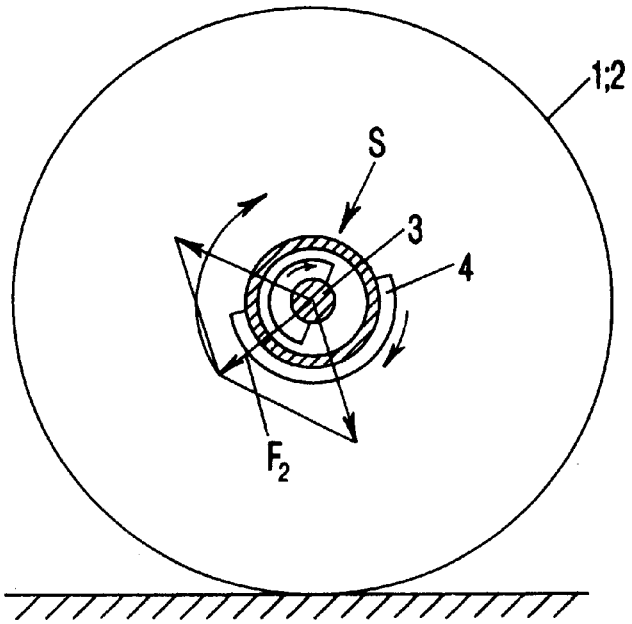

In the basic position II the unbalance shaft 3 is also driven by the hydraulic motor 9 via a clutch 10 positioned therebetween. Changes and fixation of the phase position of the unbalanced shaft 3 relative to the unbalanced shaft 4 are performed in the following simple manner:

The unbalanced shaft 3 is first arrested in its current position by the hydraulic motor 9 and, subsequently, the housing-like stay 15 of the differential is adjusted, if needed, manually (not represented in the drawing) or with a control mechanism, for example, the one shown in FIG. 3, i.e., with the hydraulic motor 31 and the gear wheel pair 30, 16 until the resulting changing phase position between the unbalanced shaft 3 and 4 has reached the desired value. Then the now present relative phase position of the unbalanced shafts 3 and 4 is arrested, for which purpose a rigid connection must be produced between the drive shaft of the hydraulic motor 9 and the stay 15, for example, with a switchable clutch (not shown in the drawing) and, simultaneously, the connection between the gear wheels 16 and 30 must be released. Thus, the housing-like stay 15, the bevel gears 11, 12, 13 and 14, and the unbalanced shafts 3, 4, positioned relative to one another and fixed relative to one another, form a single vibration unit rotating in the same direction of rotation and thus exert onto the roll tires a centrifugal force that rotates about the drive axis 28 and the size of which depends on the adjusted relative phase position of the unbalanced shafts 3 and 4. This operation is schematically shown in FIGS. 8*a* and 8*b* for different adjustments of the phase relation of the unbalanced shafts 3 and 4.

The present invention is, of course, in no way restricted to the specific disclosure of the specification and drawings, but also encompasses any modifications within the scope of the appended claims.

What I claim is:

1. A vibration roller comprising:

at least one roll tire having a double shaft vibration generator arranged therein;

said double shaft vibration generator comprising a first driven unbalance shaft and a second driven unbalance shaft arranged in said at least one roll tire;

said roll tire having an inner support;

said first and second driven unbalance shafts rotatably supported in said inner support;

said first and second driven unbalance shaft coaxially arranged relative to one another on a common rotational axis such that said second driven unbalance shaft is rotatable about said first driven unbalance shaft;

said roll tire having a drive axis;

said common rotational axis of said first and second driven unbalance shafts coinciding with said drive axis of said roll tire;

wherein, for a first operational state of said vibration roller in which a directed vibration is generated, said first and second driven unbalance shaft are coupled such that said first and second driven unbalance shafts rotate in opposite directions to one another and wherein a position angle between a maximum resulting centrifugal force (force vector) and a travel direction of said vibration roller is selectable as desired; and wherein, for a second operational state of said vibration roller in which a circular vibration about said roll tire is generated, said first and second driven unbalance shaft are coupled such that said first and second driven unbalance shafts rotate in the same direction and wherein a relative phase position for adjusting a value of the resulting centrifugal force is selectable as desired.

2. A vibration roller according to claim 1, wherein said first and second driven unbalance shafts are supported in said at least one roll tire so as to be unaffected by a rotational movement of said roll tire.

3. A vibration roller according to claim 1, wherein said support is comprised of two axially spaced end faces of said roll tire, wherein each one of said end faces comprise a first bearing housing with a first roller bearing arranged therein for supporting said second driven unbalance shaft.

4. A vibration roller according to claim 3, further comprising an undercarriage, wherein said first roller bearings function simultaneously as drive bearings for supporting said roll tire at said undercarriage.

5. A vibration roller according to claim 3, further comprising second roller bearings mounted within said second driven unbalance shaft in the vicinity of said first bearing housings, wherein said first driven unbalance shaft is supported in said second roller bearings.

6. A vibration roller according to claim 1, wherein in said first operational state said position angle is adjustable over the entire range of 360°.

7. A vibration roller according to claim 1, wherein, for bringing said vibration roller into said second operational state, said first and second driven unbalance shafts are manually coupled and said relative phase position is manually selected while said vibration roller is in a standstill position.

8. A vibration roller according to claim 1, wherein, for bringing said vibration roller into said second operational state, said first and second driven unbalance shafts are automatically coupled and said relative phase position is automatically selected.

9. A vibration roller according to claim 1, wherein at least in said second operational state the direction of rotation of said first and second driven unbalance shafts is changeable.

10. A vibration roller according to claim 1, wherein, for bringing said vibration roller into said first operational state, said first and second driven unbalance shafts are manually coupled and said position angle is manually selected while said vibration roller is in a standstill position.

11. A vibration roller according to claim 1, wherein, for bringing said vibration roller into said first operational state, said first and second driven unbalance shafts are automatically coupled and said position angle is automatically selected.

12. A vibration roller according to claim 11, further comprising a differential, connected to a first end of said first driven unbalance shaft and to a first end of said second driven unbalance shaft, and further comprising a control drive connected to said differential; wherein:

said differential comprises two oppositely rotating central gears of identical number of teeth;

a first one of said central gears is fixedly and coaxially connected to said first driven unbalance shaft;

a second one of said central gears is fixedly and coaxially connected to said second driven unbalance shaft;

said differential comprises a stay rotatable about said drive axis of said roll tire;

said control drive driving said stay in rotation for selecting a relative phase position between said first and second driven unbalance shafts; and said stay arrestable for a selected relative phase position at a roll tire holder of said roll tire.

13. A vibration roller according to claim 12, wherein said differential is a bevel gear arrangement.

14. A vibration roller according to claim 12, wherein:

said stay is embodied as a pivotable housing surrounding said first end of said first driven unbalance shaft;

said pivotable housing has a first end face facing said roll tire holder;

said control drive comprises a control motor connected to said roll tire holder;

said control drive comprises a control gear connected to said first end face of said pivotable housing so as to be coaxial with said drive axis of said roll tire;

said control drive further comprises a pinion driven by said control motor; and said control gear meshes with said pinion.

15. A vibration roller according to claim 12, wherein, for bringing said vibration roller into said second operational position, said stay is coupled with one of said first and second driven unbalance shafts, and wherein said pinion and said control gear are detachable from one another.

16. A vibration roller according to claim 12, wherein said roll tire comprises two axially spaced end faces and wherein one of said end faces has connected thereto a drive bearing housing in which said stay is rotatably supported.

17. A vibration roller according to claim 16, wherein said drive bearing housing encloses said differential so as to form a protective housing.

18. A vibration roller according to claim 1, further comprising a comparator element, a first transducer and a second transducer connected to said comparator element, and a control drive, wherein, in said first operational state, said first transducer sends first signals of an angular velocity and an angular acceleration of a non-slip roll tire to said comparator element and said second transducer sends second signals of an angular velocity and an angular acceleration of a roll tire having a tendency to slip to said comparator element, wherein said comparator element compares said first and second signals and, upon surpassing of a preset difference of said first and second signals, activates said control drive to reduce accordingly said position angle.

19. A vibration roller according to claim 1, wherein said first and second driven unbalance shafts have identical flywheel effects.

20. A method for operating a vibration roller according to claim 1, including the step of adjusting in said first operational state said position angle to be 0° to 45° for loose or bituminous soils and to be 45° to 90° for soils that are difficult to compact.

21. A method according to claim 20, further including the step of program-controlling said position angle as a function of a thickness of the soil to be compacted.

22. A method according to claim 20, further including the step of automatically adjusting mirror-symmetrically said force vector to a plane extending parallel to the ground and containing said drive axis, when a reversal of travel direction occurs.

23. A method according to claim 20, further including the step of reducing program-controlled said position angle with each pass across the soil to be compacted.

* * * * *